US010544799B2

(12) United States Patent
Jiang et al.

(10) Patent No.: US 10,544,799 B2
(45) Date of Patent: Jan. 28, 2020

(54) CENTRIFUGAL COMPRESSOR GAS-SUPPLEMENTING STRUCTURE AND COMPRESSOR

(71) Applicant: GREE ELECTRIC APPLIANCES, INC. OF ZHUHAI, Zhuhai, Guangdong (CN)

(72) Inventors: Nan Jiang, Guangdong (CN); Zhiping Zhang, Guangdong (CN); Ruixing Zhong, Guangdong (CN); Caiyun Jiang, Guangdong (CN); Rong Xie, Guangdong (CN); Jianfei Liu, Guangdong (CN); Yuhui Chen, Guangdong (CN); Baoqian Huang, Guangdong (CN); Jing Zhang, Guangdong (CN); Yi Zhou, Guangdong (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 0 days.

(21) Appl. No.: 15/768,371

(22) PCT Filed: Oct. 13, 2016

(86) PCT No.: PCT/CN2016/102040
§ 371 (c)(1),
(2) Date: Apr. 13, 2018

(87) PCT Pub. No.: WO2017/063576
PCT Pub. Date: Apr. 20, 2017

(65) Prior Publication Data

US 2018/0306202 A1 Oct. 25, 2018

(30) Foreign Application Priority Data

Oct. 15, 2015 (CN) ..... 2015 1 0677318

(51) Int. Cl.
*F04D 29/44* (2006.01)
*F04D 29/66* (2006.01)

(52) U.S. Cl.
CPC ..... *F04D 29/44* (2013.01); *F04D 29/667* (2013.01)

(58) Field of Classification Search
CPC ..... F04D 29/44; F04D 29/66; F04D 29/667; F04D 29/684; F04D 27/0215; F04D 27/0238
See application file for complete search history.

(56) References Cited

U.S. PATENT DOCUMENTS 3,171,353 A 3/1965 McMahan
3,462,071 A * 8/1969 Garve ..... F02B 33/00 415/116

(Continued)

FOREIGN PATENT DOCUMENTS

CN 101949393 A 1/2011
CN 202250938 U * 5/2012

(Continued)

OTHER PUBLICATIONS

WIPO, International Search Report dated Dec. 28, 2016.

(Continued)

*Primary Examiner* — Brian P Wolcott
(74) *Attorney, Agent, or Firm* — Li & Cai Intellectual Property (USA) Office

(57) ABSTRACT

Provided are a centrifugal compressor gas-supplementing structure and a compressor using the foregoing gas-supplementing structure. The centrifugal compressor gas-supplementing structure includes a annular gas-supplementing passage (6) for introducing supplemented gas into a gas passage (5) of a compressor, and an airflow-guiding assembly is provided in the annular gas-supplementing passage (Continued)

(6). The gas-guiding assembly is used for adjusting a direction of the supplemented gas flowing into the gas passage (5), so that an angle between a direction of the supplemented gas flowing into the gas passage (5) and a direction of an airflow in the gas passage (5) falls within a preset range, and a turbulence loss generated when the two passages of gas merge is avoided to the greatest extent, thereby improving cycle efficiency.

12 Claims, 4 Drawing Sheets

(56) References Cited

U.S. PATENT DOCUMENTS

| | | | | | |
|---|---|---|---|---|---|
| 7,641,439 | B2 * | 1/2010 | Chen | F04D 29/441 415/116 | |
| 9,382,911 | B2 * | 7/2016 | Sun | F04D 27/0238 | |

FOREIGN PATENT DOCUMENTS

| | | | | | |
|---|---|---|---|---|---|
| CN | 202441619 | U | | 9/2012 | |
| CN | 103016409 | A | * | 4/2013 | F04D 29/684 |
| CN | 103016409 | A | | 4/2013 | |
| CN | 103206389 | A | | 7/2013 | |
| CN | 203201801 | U | | 9/2013 | |
| CN | 204061332 | U | | 12/2014 | |
| CN | 104454652 | A | | 3/2015 | |
| CN | 104533836 | A | * | 4/2015 | |
| CN | 104533836 | A | | 4/2015 | |
| CN | 204692191 | U | | 10/2015 | |
| CN | 105240320 | A | | 1/2016 | |
| CN | 205047530 | U | | 2/2016 | |
| JP | H08284892 | A | | 10/1996 | |
| JP | H0979192 | A | | 3/1997 | |
| JP | 3873481 | B2 | * | 1/2007 | F04D 17/122 |
| JP | 2007309154 | A | | 11/2007 | |
| JP | 2009068423 | A | | 4/2009 | |
| JP | 2010106746 | A | | 5/2010 | |
| KR | 10-2015-0113580 | A | | 10/2015 | |

OTHER PUBLICATIONS

China Patent Office, Patent Search Report.
European Patent Office, Patent Search Report dated Apr. 17, 2019.

* cited by examiner

CENTRIFUGAL COMPRESSOR GAS-SUPPLEMENTING STRUCTURE AND COMPRESSOR

TECHNICAL FIELD

The present invention relates to a field of compressors, and more particularly to a centrifugal compressor gas-supplementing structure and a compressor having the same.

BACKGROUND

In order to improve a cycle efficiency of a two-stage or multi-stage centrifugal compressor, a cycle with an economizer is often used. A flashing gas refrigerant in the economizer enters into a next-stage impeller or a bend of a return device via a gas-supplementing passage for supplementing gas. A gas-supplementing mode may be single-point gas supplement, or 360° annular gas supplement. The single-point gas supplement may generate local turbulence losses, thereby resulting in a certain efficiency waste, and limiting a usage range. The 360° annular gas supplement may be better integrated with a previous-stage impeller, so that gas is more uniform, and turbulence losses are reduced to the greatest extent, thereby better improving cycle efficiency.

A gas-supplementing position of a 360° annular gas-supplementing structure is not specially treated, generally. Once a flowing speed of gas at the gas-supplementing position is high or low relative to that of gas in a diffuser passage, turbulence losses will be generated, thereby affecting the cycle efficiency of the entire compressor.

In view of the above problems, it is urgently necessary to provide a novel centrifugal compressor gas-supplementing structure, so as to solve a problem in the prior art of influence on the cycle efficiency of an entire compressor caused by turbulence losses due to mixing of supplemented gas and gas in a gas passage of the compressor.

SUMMARY

The present invention provides a centrifugal compressor gas-supplementing structure capable of effectively preventing turbulence losses caused by mixing of supplemented gas and an airflow in a gas passage.

To this end, the present invention adopts the technical solution as follows.

A centrifugal compressor gas-supplementing structure comprises an annular gas-supplementing passage for introducing supplemented gas into a gas passage of a compressor, wherein an airflow-guiding assembly is provided in the annular gas-supplementing passage, and the gas-guiding assembly is used for adjusting a direction of the supplemented gas flowing into the gas passage, so that an angle between a direction of the supplemented gas flowing into the gas passage and a direction of an airflow in the gas passage falls within a preset range.

Further, the preset range is −5° to 5°.

Further, the airflow-guiding assembly comprises at least one group of guide vanes provided in a circumferential direction of the annular gas-supplementing passage.

Further, each of the guide vanes is of a flat plate shape, an inclined direction thereof is the same as a rotating direction of a return vane of the compressor;

or, each of the guide vanes is of a spiral shape, a rotating direction thereof is the same as a rotating direction of a return vane of the compressor.

Further, viewed from an axial direction of an impeller, each of the guide vanes is provided outside a radial direction of the return vane; and each of the guide vanes is provided on a spiral line extending outward in a spiral direction of the return vane, or each of the guide vanes and the return vane are provided at intervals.

Further, two opposite side surfaces of each of the guide vanes are connected with an inner wall of the annular gas-supplementing passage respectively.

Further, a thickness of each of the guide vanes is the same as a thickness of the return vane.

Further, the number of the guide vanes is the same as the number of return vanes.

Further, a supplemented gas outlet of the gas passage is provided at an inlet bend of a returning device and/or an inlet of a next-stage impeller, the guide vane is provided close to the supplemented gas outlet.

The present invention also provides a compressor with high cycle efficiency, wherein the compressor has a gas-supplementing structure as described above.

The present invention has the beneficial effects as follows.

1. According to the centrifugal compressor gas-supplementing structure provided in the present invention, an airflow-guiding assembly is provided in an annular gas-supplementing passage, and a direction of supplemented gas flowing into a gas passage is adjusted via the airflow-guiding assembly, so that an angle between a direction of the supplemented gas flowing into the gas passage and a direction of an airflow in the gas passage falls within a preset range, and a turbulence loss generated when the two passages of gas merge is avoided to the greatest extent, thereby improving cycle efficiency.

2. The compressor provided in the present invention adopts the above gas-supplementing structure, thereby greatly improving the cycle efficiency.

BRIEF DESCRIPTION OF THE DRAWINGS

The above and other objects, features and advantages of the present invention will become more apparent from the following description of the embodiments of the present invention with reference to the accompanying drawings in which.

1、Housing; 2、impeller; 3、diffuser; 4、returning device; 41、return vane; 5、gas passage; 6、annular gas-supplementing passage; 61、supplemented gas inlet; 62、supplemented gas outlet; 7、guide vane; a、upper deviation of direction of supplemented gas flowing into gas passage; b、 direction of gas in gas passage; c、 lower deviation of direction of supplemented gas flowing into gas passage.

DETAILED DESCRIPTION OF THE EMBODIMENTS

The present invention is described below based on embodiments, but the present invention is not limited to these embodiments. In the following detailed description of the present invention, some specific details are described in detail. The present invention may be fully understood by those skilled in the art without the description of these details. In order to avoid obscuring the essence of the present invention, well-known methods, processes, flows and elements have not been described in detail.

Figure 5:
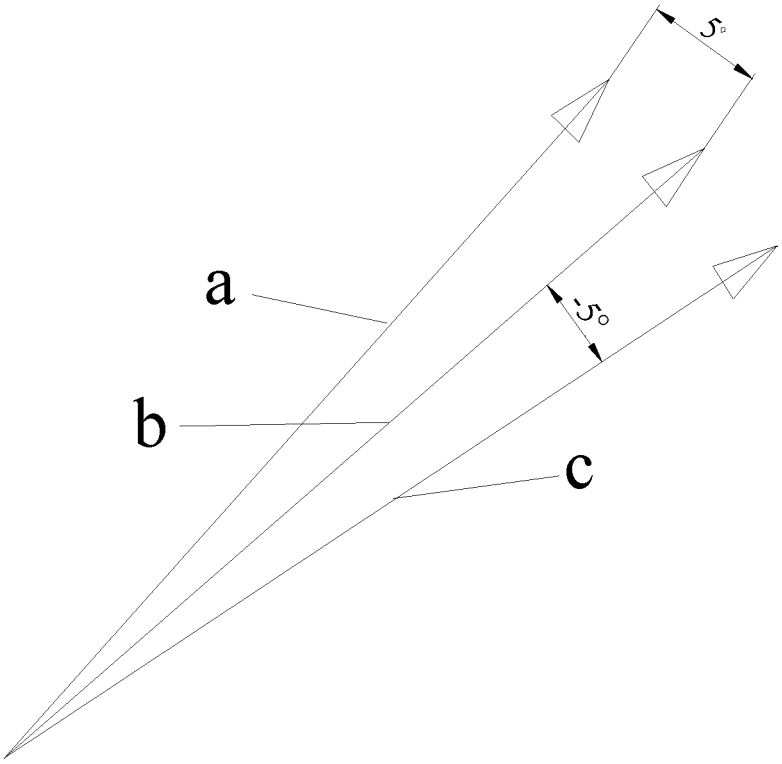
FIG. 5 is a diagram illustrating an angle range between a direction of supplemented gas flowing into a gas passage in a centrifugal compressor gas-supplementing structure and a direction of an airflow in the gas passage according to an embodiment of the present invention.

The present invention provides a centrifugal compressor gas-supplementing structure, comprising an annular gas-supplementing passage for introducing supplemented gas into a gas passage of a compressor, and an airflow-guiding assembly provided in the annular gas-supplementing passage, wherein the gas passage is a passage through which a gas in the compressor flows. By means of the airflow-guiding assembly, a direction of the supplemented gas flowing into the gas passage is adjusted, so that an angle between a direction of the supplemented gas flowing into the gas passage and a direction of air in the gas passage falls within a preset range, and a turbulence loss generated when the two channels of gas merge is avoided to the greatest extent, thereby improving a cycle efficiency. Of course, as the preset range is smaller, the turbulence losses can be more reduced. Preferably, as shown in FIG. 5, the preset range of the angle between the direction of the supplemented gas flowing into the gas passage and the direction of the airflow in the gas passage is −5° to 5°. Specifically, an angle between an upper deviation a of a direction of supplemented gas flowing into a gas passage and a direction b of airflow in a gas passage is 5°, and an angle between a lower deviation c of a direction of supplemented gas flowing into a gas passage and a direction b of airflow in a gas passage is −5°.

As a preferred mode, the airflow-guiding assembly comprises a group of guide vanes provided in a circumferential direction of the annular gas-supplementing passage. The guide vanes are uniformly provided in the annular gas-supplementing passage, a supplemented gas passage is formed between every two adjacent guide vanes, and a direction of supplemented airflow is changed under a guide action of the two adjacent guide vanes.

The shape of the guide vane may be, but is not limited to, a flat plate shape or a spiral shape, and can achieve a guide action so as to change a direction of the supplemented gas. Further, if the guide vane is of a flat plate shape, an inclined direction thereof is the same as a rotating direction of a return vane of the compressor; and if the guide vane is of a spiral shape, a rotating direction thereof is the same as a rotating direction of a return vane of the compressor, so as to achieve a good guide effect.

Figure 1:
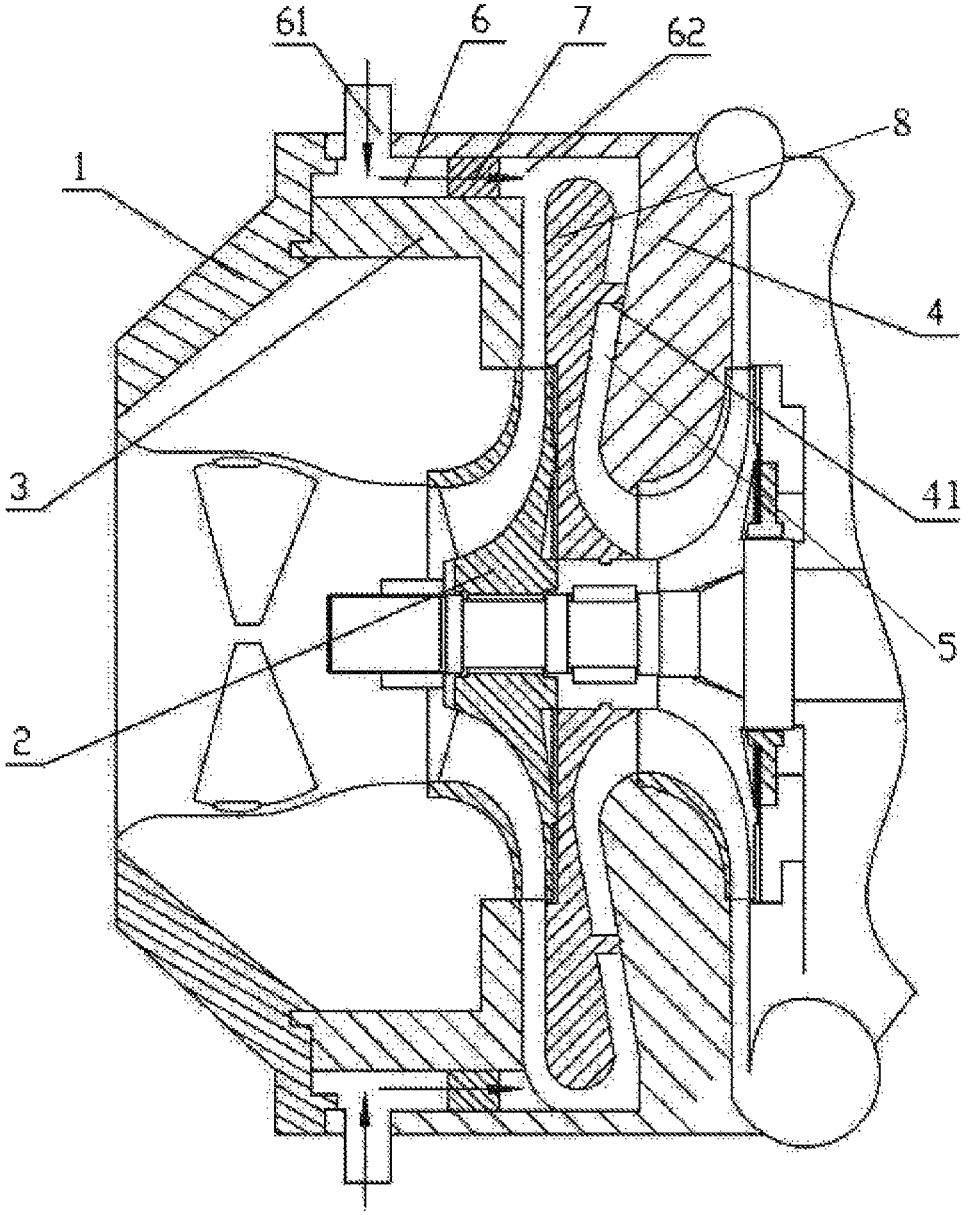
FIG. 1 is a first structure schematic diagram of a centrifugal compressor gas-supplementing structure according to an embodiment of the present invention.
Figure 2:
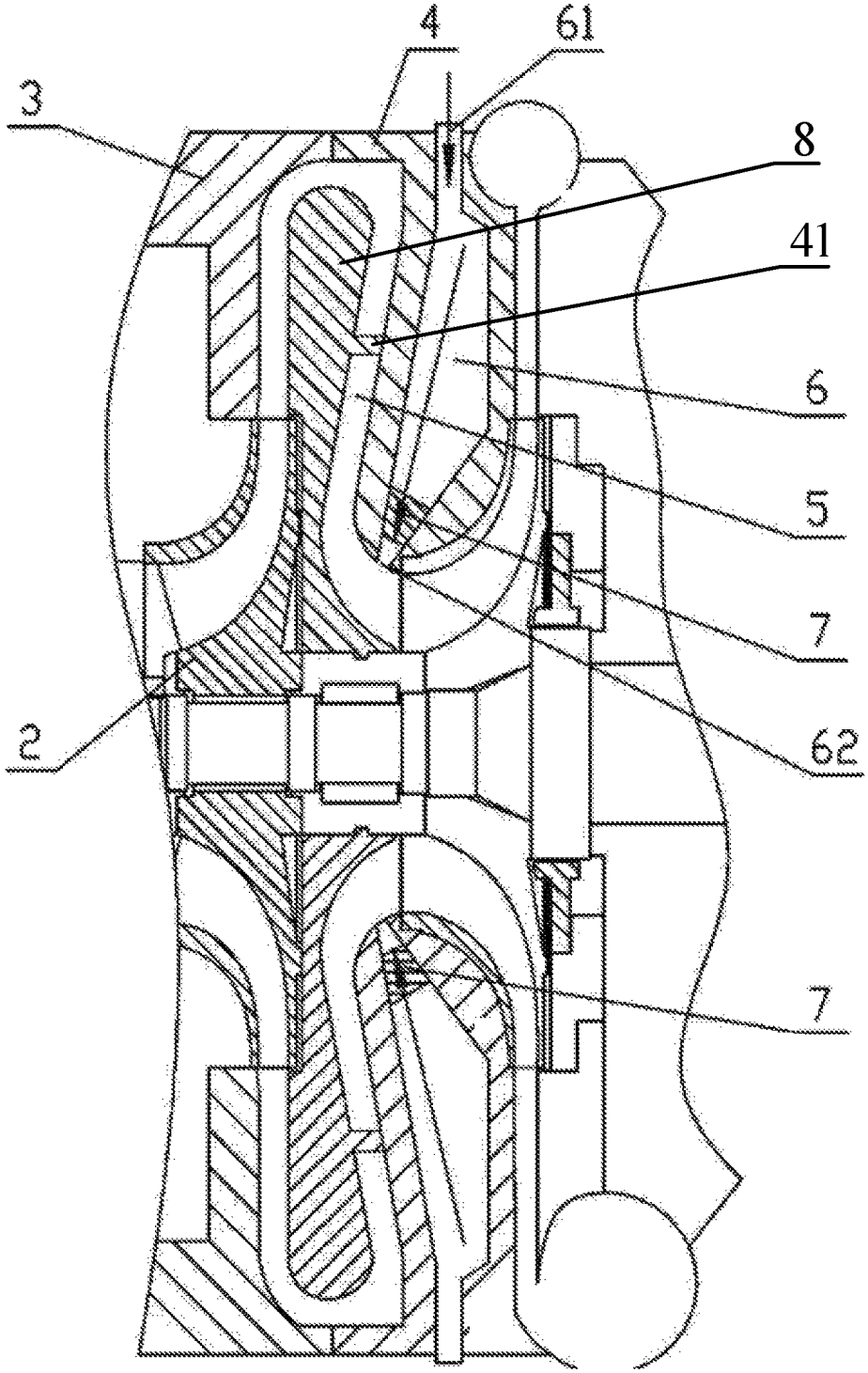
FIG. 2 is a second structure schematic diagram of a centrifugal compressor gas-supplementing structure according to an embodiment of the present invention.

Specifically, as shown in FIG. 1 and FIG. 2, the compressor comprises a housing 1, and an impeller 2, a diffuser 3 and a returning device 4, provided in the housing 1, a gas passage 5 is formed by the impeller 2, the diffuser 3 and the returning device 4 together. An annular gas-supplementing passage 6 communicates with the gas passage 5 via a supplemented gas outlet 62. The supplemented gas outlet 62 may be provided at an inlet bend of the returning device 4 as shown in FIG. 1. The annular gas-supplementing passage 6 is provided between the diffuser 3 and the returning device 4, and jointly enclosed by wall surfaces of the housing 1, the diffuser 3 and the returning device 4. A supplemented gas inlet 61 of the annular gas-supplementing passage 6 is provided on an outer peripheral wall of the returning device 4, supplemented gas entering into the annular gas-supplementing passage 6 from the supplemented gas inlet 61 and flowing into the gas passage 5 from the supplemented gas outlet 62. It may also be provided at an inlet of a next-stage impeller as shown in FIG. 2. The supplemented gas inlet 61 is provided on an outer peripheral wall of the returning device 4, and the annular gas-supplementing passage 6 extends radially inwardly from the supplemented gas inlet 61 to the gas passage 5. Of course, other positions convenient for supplementing gas are also available. The guide vane 7 is provided close to the supplemented gas outlet 62, and has a better guide effect.

Figure 3:
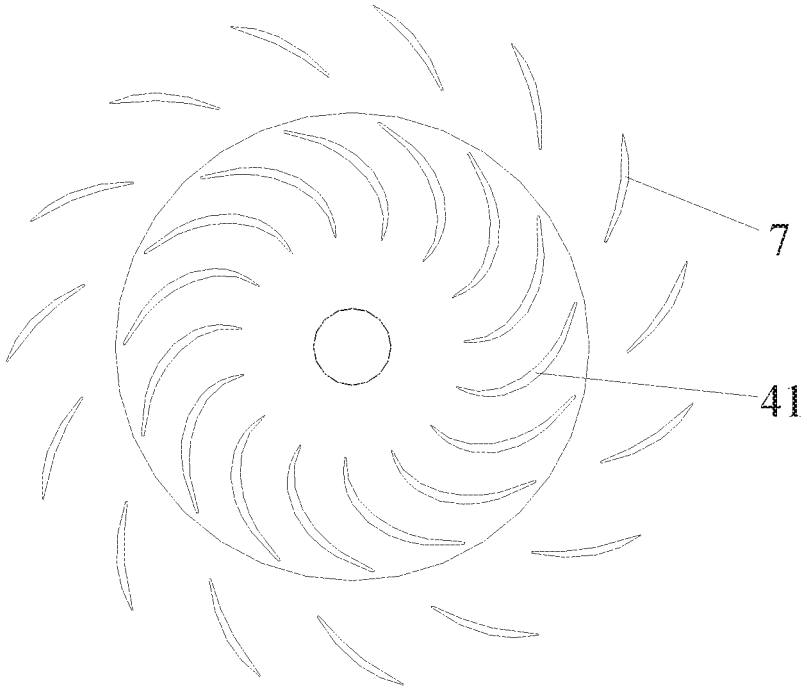
FIG. 3 is a schematic diagram 1 illustrating a positional relationship between a guide vane and a return vane on a surface perpendicular to an axis of a compressor according to an embodiment of the present invention.
Figure 4:
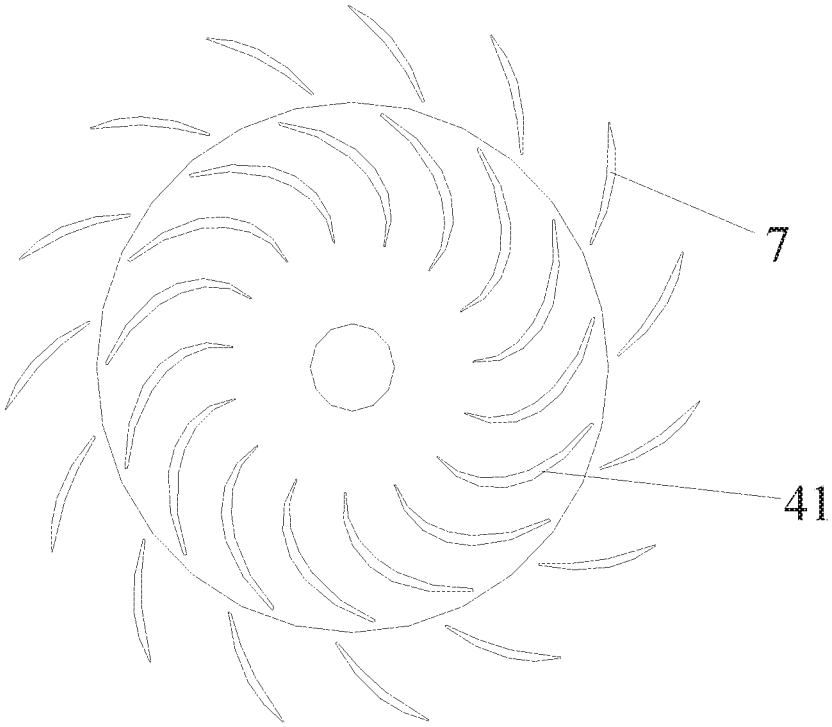
FIG. 4 is a schematic diagram 2 illustrating a positional relationship between a guide vane and a return vane on a surface perpendicular to an axis of a compressor according to an embodiment of the present invention.

The number and arrangement of the guide vanes 7 are not limited, and an effect of adjusting a direction of the supplemented gas can be achieved. Preferably, viewed from an axial direction of an impeller, each of the guide vanes 7 is provided outside a radial direction of the return vane 41. Further preferably, as shown in FIG. 3, each of the guide vanes 7 is provided on a spiral line extending outward in a spiral direction of the return vane 41 or, as shown in FIG. 4, each of the guide vanes 7 is spaced from the return vane 41. The spacing here means that a radially inward end of the guide vane 7 is provided between two adjacent return vanes 41. Both of the above two arrangements can achieve a good homogenization and guide effect on supplemented gas. Preferably, the radially outward ends of the guide vanes 7 are all provided on the same circle, and the radially inward ends of the guide vanes 7 are all provided on the same circle.

Since the supplemented gas outlet 62 is generally narrow, it is difficult to add the guide vane 7 alone. Therefore, the guide vanes 7 and the returning device 4 are formed together and as one whole structure by casting, and two opposite side surfaces of each of the guide vanes 7 are connected to the annular gas-supplementing passage 6 respectively, so that it may be used as a guide vanes 7 and may also be used as a reinforcing rib to increase the structural strength and improve a usage reliability of the compressor. Preferably, each of the guide vanes 7 and the inner wall of the annular gas-supplementing passage 6 make a smooth curved surface transition, thereby further improving the guide effect and the structural reliability.

The guide vane 7 may not be too thick when casting, nor too thin. If it is too thick, it will have a large friction loss, and it will produce a large trail loss at a tail of the vane, thereby causing a great influence on the performance. If it is too thin, it will not be easy to cast. Preferably, a thickness of each of the guide vanes 7 is similar to or the same as the thickness of the return vane 41.

The number of guide vanes 7 should not be too large or too small. If it is too large, a resistance of supplemented gas will be increased, thereby affecting the effect of supplementing gas. If it is too small, a guide effect will be poor. Preferably, the number of guide vanes 7 is 12 to 18, which is generally consistent with the number of return vanes 41. When the diameter is larger, the number of guide vanes 7 is larger, and vice versa.

Herein, the guide vanes are not limited to one group. In view of the guide effect, the size of the compressor and other factors, two or more groups of guide vanes may be provided. The arrangement manner is similar to that of the above-mentioned guide vanes, and will not be elaborated herein. In addition, the gas-guiding assembly is not limited to the guide vanes, and may be of other structures capable of changing the direction of the supplemented gas such as bumps and guide grooves.

In view of the above-mentioned gas-supplementing structure, the present invention also provides a compressor having the above-mentioned centrifugal compressor gas-supplementing structure, thereby greatly improving a cycle efficiency of the compressor and a structural reliability.

Moreover, those of ordinary skill in the art should understand that the drawings provided herein are for illustration purposes only and the drawings are not necessarily drawn to scale.

Meanwhile, it should be understood that exemplary embodiments are provided so that this disclosure will be thorough, and will fully convey the scope to those skilled in the art. Many specific details (such as examples of specific components, equipment, and methods) are set forth to provide a thorough understanding of the present invention. It will be apparent to those skilled in the art that specific details do not need to be employed, that exemplary embodiments may be implemented in many different forms, and that exemplary embodiments should not be interpreted as limiting the scope of the present invention. In some exemplary embodiments, well-known processes, well-known equipment structures and well-known technologies are not described in detail.

The term used herein is for the purpose of describing particular exemplary embodiments only and is not intended to be limiting. As used herein, the singular forms "a", "an" and "the" are intended to include the plural forms as well, unless the context clearly indicates otherwise. The terms "comprising", "including", "containing" and "having" are intended to be inclusive and thus clearly indicate the existence of the stated features, integers, steps, operations, elements and/or components, but do not preclude the presence or addition of one or more other features, integers, steps, operations, elements, components, and/or combinations thereof. The method steps, processes, and operations described herein will not be interpreted as necessarily requiring their performance in the particular order discussed or illustrated, unless specifically identified as an order of performance. It will also be understood that additional or alternative steps may be employed.

When an element or layer is referred to as being "on", "joined to", "connected to" or "coupled to" another element or layer, it may be directly on the other element or layer, directly joined, connected or coupled to the other element or layer, or there may be an intermediate element or layer. In contrast, when an element is referred to as being "directly on", "directly joined to", "directly connected to", or "directly coupled to" another element or layer, there may be no intermediate elements or layers. Other words used to describe a relationship between elements should be interpreted in a similar manner (e.g., "between" and "directly between", "adjacent" and "directly adjacent", etc.). As used herein, the term "and/or" includes any and all combinations of one or more of the associated listed items.

Although the terms first, second, third and the like may be used herein to describe various elements, components, regions, layers and/or sections, these elements, components, regions, layers and/or sections should not be limited by these terms. These terms may be only used to distinguish one element, component, region, layer or section from another element, region, layer or section. When terms such as "first", "second" and other numerical terms are used herein, it does not imply a sequence or order unless clearly indicated by the context. Thus, a first element, component, region, layer or section discussed below may be termed a second element, component, region, layer or section without departing from the teachings of the exemplary embodiments. In addition, in the description of the present invention, "multiple" means two or more unless otherwise specified.

For ease of explanation, spatially related terms such as "inside", "outside", "beneath", "below", "lower", "above" and "upper" are used herein to describe a relationship between one element or feature and another element or feature illustrated in the drawings. It will be understood that the spatially related terms may be intended to include different orientations of equipment in use or operation in addition to the orientation depicted in the figures. For example, if the equipment in the figures is turned over, elements described as "below" or "beneath" other elements or features would then be oriented "above" the other elements or features. Thus, the example term "below" can include both upper and lower orientations. The equipment may be otherwise oriented (rotated for 90 degrees or at other orientations), and spatially related descriptors used herein should be interpreted accordingly.

The foregoing descriptions are merely preferred embodiments of the present invention and are not intended to limit the present invention. For those skilled in the art, the present invention may have various changes and modifications. Any modification, equivalent replacement and improvement made within the spirit and principle of the present invention shall fall within the protection scope of the present invention.

The present invention is described below based on embodiments, but the present invention is not limited to these embodiments. In the following detailed description of the present invention, some specific details are described in detail. The present invention may be fully understood by those skilled in the art without the description of these details. In order to avoid obscuring the essence of the present invention, well-known methods, processes, flows and elements have not been described in detail.

What is claimed is:

1. A centrifugal compressor gas-supplementing structure, comprising an annular gas-supplementing passage (6) for introducing supplemented gas into a gas passage (5) of a compressor, wherein an airflow-guiding assembly is provided in the annular gas-supplementing passage (6), and the airflow-guiding assembly is used for adjusting a direction of the supplemented gas flowing into the gas passage (5), so that an angle between a direction of the supplemented gas flowing into the gas passage (5) and a direction of an airflow in the gas passage (5) falls within a preset range, the airflow-guiding assembly comprises at least one group of guide vanes (7) provided in a circumferential direction of the annular gas-supplementing passage (6), wherein the preset range is −5° to 5°; wherein a thickness of each guide vane of the at least one group of guide vanes (7) is the same as a thickness of each return vane (41).

2. The centrifugal compressor gas-supplementing structure as claimed in claim 1, wherein each guide vane of the at least one group of guide vanes (7) is of a flat plate shape, an inclined direction thereof is the same as an inclined direction of each return vane (41) of the compressor; or, each guide vane of the at least one group of guide vanes (7) is of a spiral shape, a spiral direction thereof is the same as an inclined direction of each return vane (41) of the compressor.

3. The centrifugal compressor gas-supplementing structure as claimed in claim 2, wherein viewed from an axial direction of an impeller, each guide vane of the at least one group of the guide vanes (7) is provided radially outside of each return vane (41); and each guide vane of the at least one group of guide vanes (7) is provided on a spiral line extending outward in a spiral direction of each return vane (41), or the each guide vane of the at least one group of the guide vanes (7) is spaced from each corresponding return vane (41).

4. The centrifugal compressor gas-supplementing structure as claimed in claim 1, wherein two opposite side surfaces of each guide vane of the at least one group of guide vanes (7) are connected with an inner wall of the annular gas-supplementing passage (6) respectively.

5. The centrifugal compressor gas-supplementing structure as claimed in claim 1, wherein the number of guide vanes in the at least one group of guide vanes (7) is the same as the number of return vanes (41).

6. The centrifugal compressor gas-supplementing structure as claimed in claim 1, wherein a supplemented gas outlet (62) of the gas passage (5) is provided at an inlet bend of a returning device (4) and/or an inlet of a next-stage impeller, each of the at least one group of guide vanes (7) is provided closer to the supplemented gas outlet (62) relative to a supplemented gas inlet (61).

7. The centrifugal compressor gas-supplementing structure as claimed in claim 2, wherein two opposite side surfaces of each guide vane of the at least one group of guide vanes (7) are connected to an inner wall of the annular gas-supplementing passage (6) respectively.

8. The centrifugal compressor gas-supplementing structure as claimed in claim 3, wherein two opposite side surfaces of each guide vane of the at least one group of guide vanes (7) are connected to an inner wall of the annular gas-supplementing passage (6) respectively.

9. The centrifugal compressor gas-supplementing structure as claimed in claim 2, wherein the number of guide vanes in the at least one group of guide vanes (7) is the same as the number of return vanes (41).

10. The centrifugal compressor gas-supplementing structure as claimed in claim 3, wherein the number of guide vanes in the at least one group of guide vanes (7) is the same as the number of return vanes (41).

11. A centrifugal compressor gas-supplementing structure, comprising an annular gas-supplementing passage (6) for introducing supplemented gas into a gas passage (5) of a compressor, wherein an airflow-guiding assembly is provided in the annular gas-supplementing passage (6), and the airflow-guiding assembly is used for adjusting a direction of the supplemented gas flowing into the gas passage (5), so that an angle between a direction of the supplemented gas flowing into the gas passage (5) and a direction of an airflow in the gas passage (5) falls within a preset range, the airflow-guiding assembly comprises at least one group of guide vanes (7) provided in a circumferential direction of the annular gas-supplementing passage (6), wherein a thickness of each guide vane of the at least one group of guide vanes (7) is the same as a thickness of each return vane (41).

12. A centrifugal compressor gas-supplementing structure, comprising an annular gas-supplementing passage (6) for introducing supplemented gas into a gas passage (5) of a compressor, wherein an airflow-guiding assembly is provided in the annular gas-supplementing passage (6), and the airflow-guiding assembly is used for adjusting a direction of the supplemented gas flowing into the gas passage (5), so that an angle between a direction of the supplemented gas flowing into the gas passage (5) and a direction of an airflow in the gas passage (5) falls within a preset range, the airflow-guiding assembly comprises at least one group of guide vanes (7) provided in a circumferential direction of the annular gas-supplementing passage (6), wherein the preset range is −5° to 5°; wherein the number of guide vanes in the at least one group of guide vanes (7) is the same as the number of return vanes (41).

* * * * *